United States Patent [19]

Voswinckel

[11] 4,317,290

[45] Mar. 2, 1982

[54] HEAT TREATMENT APPARATUS

[75] Inventor: Gerhard Voswinckel, Aachen, Fed. Rep. of Germany

[73] Assignee: H. Krantz GmbH & Co., Aachen, Fed. Rep. of Germany

[21] Appl. No.: 187,784

[22] Filed: Sep. 16, 1980

[30] Foreign Application Priority Data

Oct. 4, 1979 [DE] Fed. Rep. of Germany ... 7928210[U]

[51] Int. Cl.[3] ..... F26B 13/02

[52] U.S. Cl. ..... 34/86; 34/213; 34/216; 432/163; 432/164; 432/170

[58] Field of Search ..... 34/35, 86, 213, 216, 34/217; 432/128, 130, 152, 163, 164, 170

[56] References Cited

U.S. PATENT DOCUMENTS

| | | | |
|---|---|---|---|
| 2,314,748 | 3/1943 | White | 34/86 |
| 2,649,989 | 8/1953 | Geijerstam | 34/86 |
| 2,750,680 | 6/1956 | Houdry et al. | 34/35 |
| 2,799,096 | 7/1957 | Scott | 34/213 |
| 4,137,648 | 2/1979 | Rhodes | 34/86 |
| 4,231,165 | 11/1980 | Gresens et al. | 34/86 |
| 4,247,991 | 2/1981 | Mehta | 34/35 |
| 4,255,870 | 3/1981 | Malmquist | 34/86 |

*Primary Examiner*—Larry I. Schwartz

*Attorney, Agent, or Firm*—W. G. Fasse; D. H. Kane, Jr.

[57] ABSTRACT

An apparatus for the heat treatment of a material passing through a plurality of treatment zones using a heated gaseous treatment medium conducted in a substantially closed circuit through these zones. A heat exchanger is associated with each treatment zone. The heat exchanger defines, in an operative relation with the respective treatment zone a medium discharge path and a medium replacement path which paths are arranged in a heat exchange relationship. The fractional portion of a treatment medium discharged from each treatment zone transfers its heat and energy to the fresh replacement medium. A throttle or flow control in the medium replacement path for each treatment zone permits individualized control of draft and medium turnover according to the different conditions prevailing in each zone. A filter is also provided to prevent impurities in the medium discharge flow path from entering the heat exchanger.

6 Claims, 2 Drawing Figures

HEAT TREATMENT APPARATUS

CROSS REFERENCE TO RELATED APPLICATION

The present application is based on German Utility Model Application G 79 28 210.3; filed in the Federal Republic of Germany on Oct. 4, 1979. The priority of the German filing date is hereby expressly claimed.

BACKGROUND OF THE INVENTION

The invention relates to a device for the heat treatment of a material passing through a plurality of treatment zones. A heated gaseous treatment medium which is conducted substantially in a closed circuit is continuously replenished. A fractional portion flows off by way of a heat exchanger which supplies energy from the portion flowing off to a fresh replacement portion flowing in and added to the closed circuit.

In the case of known heat treatment devices having a plurality of treatment zones, that part or fraction of the treatment medium that is to be carried off is exhausted by way of individual channels, or ducts from the individual treatment zones of the device and is conducted to a central heat exchanger. Downstream from the central heat exchanger there is coupled a ventilator which delivers the spent and cooled treatment medium to the atmosphere. A part or fraction of new replacement medium which corresponds quantitatively to that part of the treatment medium that is carried off and vented, is preheated in a counterflow by way of the central heat exchanger and is supplied once more to the individual treatment zones by way of a fan, or blower as well as individual channels connected thereto.

As a result of the ducting or piping system necessary for this purpose, the known construction is very complicated and expensive. It requires, in addition to the fans which are present in the individual treatment zones for circulation, an additional central fan as well as a framework, suitably dimensioned depending on the particular installation to mount the central fan. Furthermore, a fan or fans, the heat exchanger, and the entire ducting and piping system have to be sealed off carefully, in order to properly separate that portion of the treatment medium that is to be carried off, from that part of the treatment medium that is to be supplied. Otherwise the mode of operation and equilibrium of the heat exchanger is disturbed, and the amount of energy recovered is reduced.

Furthermore, the ducts and pipes have to be well insulated, since their comparatively large overall surface area would, in the event of insufficient insulation, cause correspondingly large heat losses.

OBJECTS OF THE INVENTION

In view of the foregoing it is the aim of the invention to achieve the following objects singly or in combination:

to provide a heat treatment device including a plurality of treatment zones, in which the afore described disadvantages are avoided;

to provide a heat treatment apparatus having a plurality of treatment zones with individualized control over the exchange and turnover of heated gaseous treatment medium in each of the treatment zones;

to reduce the ducting and piping necessary for continuous fractional discharge and replacement of heat treatment medium;

to improve heat energy conservation in a multiple zone heat treatment apparatus and increase the efficiency of the heat exchange during the exchange and turnover of heat treatment medium in all the zones; and generally to reduce the complexity and expense of heat treatment devices having a plurality of treatment zones with continuous turnover and replacement of the treatment medium.

SUMMARY OF THE INVENTION

In order to accomplish these objects in accordance with the invention, there is associated with each treatment zone of the heat treatment apparatus at least one heat exchanger through which the replacement portion of the medium which is flowing in and added can be supplied to the suction side of a ventilator, circulator, or blower which maintains the overall flow and circulation of the medium.

In accordance with the present invention, the device for the heat treatment of a material which passes through a plurality of treatment zones, is provided with a plurality of correspondingly smaller heat exchangers associated with the individual treatment zones instead of one central heat exchanger. In this way, considerable disadvantages of the previously known devices having a central heat recovery installation can be avoided. For example, the extensive ducts and pipes for that portion of the treatment medium that is to be carried off and replaced and that portion that is newly supplied are eliminated. The heat exchanger size is constant and adapted to the performance required for one treatment zone. A larger number and therewith a more moderately priced production process of the heat exchangers is made possible. The operating costs of the device are lower, since the driving performance of an additional central fan is avoided.

In accordance with one feature of the invention, each heat exchanger has, on the replacement inflow side for the portion of the medium that is flowing in, at least one throttle member, in the form of flaps, valves, sliders, or slide valves, which regulates the amount of the medium that is added and therefore the turnover of treatment medium. As a result of this aspect of the invention, the exchange and replenishment of treatment medium can be adapted individually to each treatment zone.

A further aspect of the invention provides each heat exchanger on its inflow side for the medium fraction that is being removed and vented, at least with one filter member which rids the medium of impurities. Thus, each heat exchanger is kept free of impurities from the medium that is flowing out. In this respect the cleaning intervals of the filter members can be adapted to the different pollution conditions prevailing in the individual treatment zones.

Another feature of the invention provides that each heat exchanger is designed as a structural unit which can be easily removed and replaced through an opening in a wall of the device. This feature simplifies the maintenance of the individual heat exchangers, since the heat exchangers can be removed and replaced from the heat treatment device without dismantling and reassembling of connection ducts and pipes.

Thus, the present invention contemplates providing separate and individualized heat exchangers for each of the treatment zones in a plural zone heat treatment apparatus. Each heat exchanger is constructed and arranged in operative relation with the respective treatment zone and has a medium discharge or outflow path and a medium replacement inflow path in crossflow heat exchange relationship. According to the invention a fractional portion of the primary circulation of heated gaseous treatment medium in each treatment zone is diverted through the medium discharge path. The fractional portion continuously eliminated gives up its heat in the heat exchanger to the fresh replacement medium flowing into the treatment zone through the medium replacement flow path.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
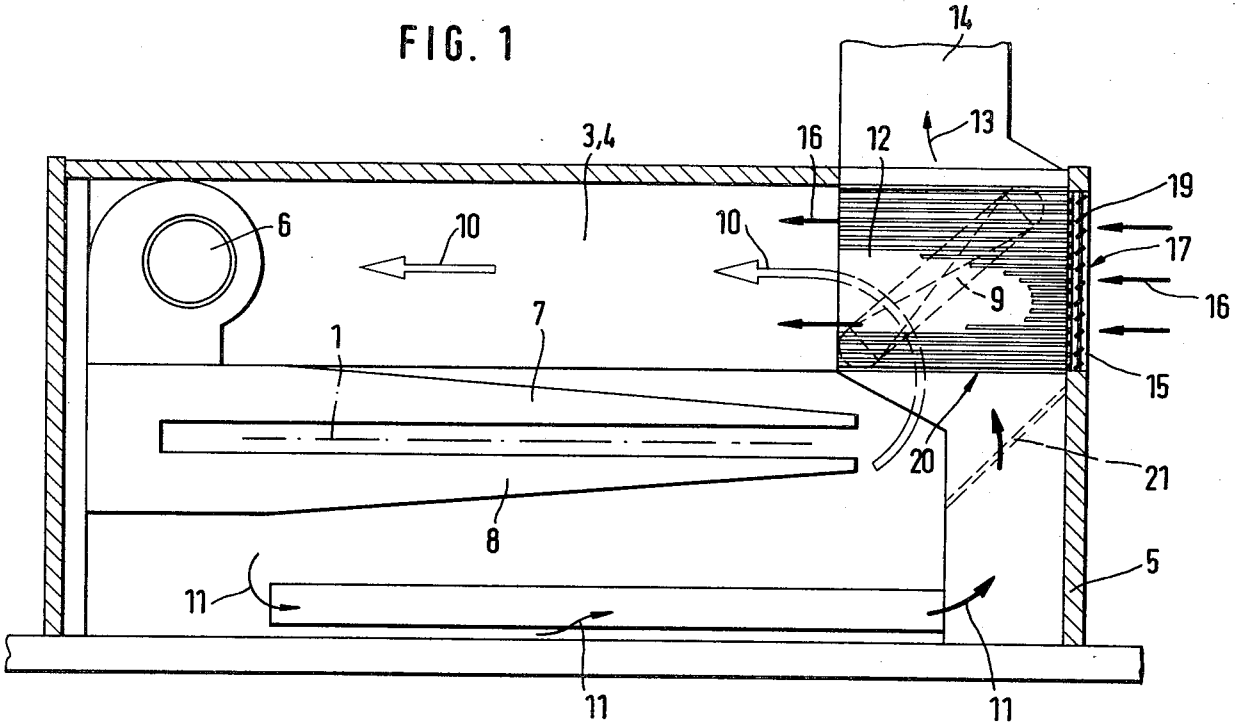
FIG. 1 shows the device in a vertical cross-section.
Figure 2:
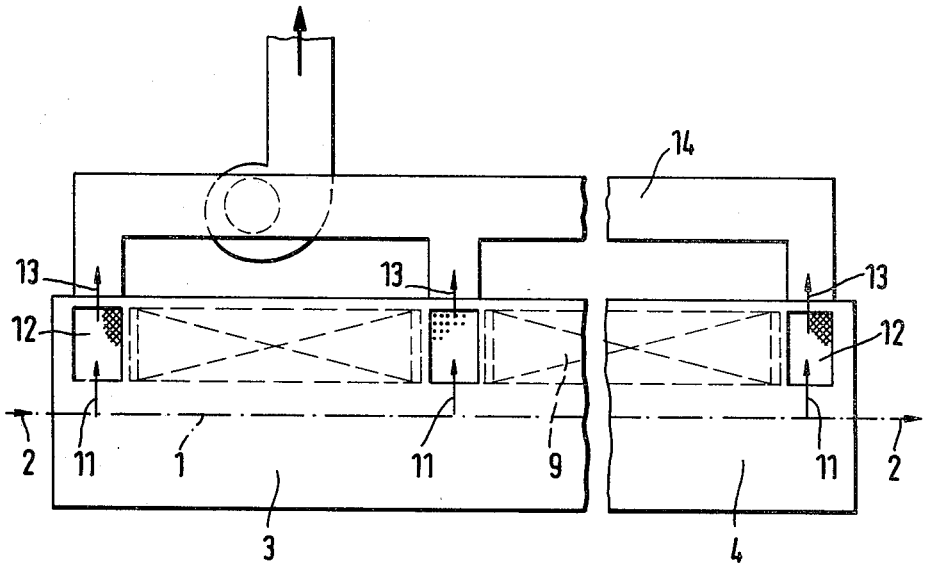
FIG. 2 shows a side view of the device consisting of two treatment zones.

A web shaped material 1 that is to be treated passes in the direction of the arrows 2 (FIG. 2) successively through zones 3 and 4 of the heat treatment device, which is surrounded by a housing 5.

In the housing 5 a ventilator blower or circulator 6 acts on nozzle boxes 7 or 8 respectively which are arranged above and below the transit path of the material 1. The blower 6 circulates the gaseous medium, heated by way of heaters or radiators 9 which maintain substantially constant treatment temperature, in the direction of the arrows 10 substantially in a closed circuit.

A fractional portion of the gaseous treatment medium is diverted and flows in the direction of the arrows 11 by way of heat exchangers 12 associated with each treatment zone 3 and 4. This fraction of the medium gives off the most substantial part of its heat and leaves the device in the direction of arrows 13 by way of a duct 14.

The heat exchangers 12 associated with each treatment zone 3 and 4 are introduced in such a way through an opening 15 in the wall of the housing 5 and are so arranged that the new replacement portion of medium which flows in as indicated by arrows 16, arrives at the suction side of the ventilator 6. This replacement medium portion is preheated by the heat exchangers 12, admixed with the treatment medium conducted in a closed circuit, and brought to treatment temperature by the radiators 9.

A throttle device 19 comprising adjustable flaps for regulating the replacement volume inflow, is disposed on the new medium and replacement inflow side 17 of the heat exchanger 12. A filter member 21 which rids the old medium of impurities, is arranged on the medium disposal input side 20 of the heat exchanger.

The heat exchanger 12 associated with each treatment zone 3 and 4 can be effortlessly removed through the opening 15 in the wall of the housing 5 for maintenance purposes. Reinsertion is accomplished through the same opening 15 without ducting or piping connections having to be dismantled or reassembled.

Although the invention has been described with reference to specific example embodiments it is to be appreciated that it is intended to cover all modifications and equivalents within the scope of the appended claims.

What is claimed is:

1. An apparatus for the substantially continuous heat treatment of a material passing through a plurality of treatment zones using a heated gaseous treatment medium conducted in a substantially closed circuit operatively interconnecting said zones, comprising: housing means enclosing said plurality of treatment zones, said housing means having an inlet opening and an outlet opening for each treatment zone, said housing means further including substantially closed circuit path means for treatment medium flow through each treatment zone; means for circulating a treatment medium through said substantially closed circuit, said treatment medium circulating means having a suction inlet and a pressure outlet, at least one heat exchange means for each zone mounted inside said housing means in operative relation to said respective housing inlet and outlet openings, said heat exchange means defining in each treatment zone a medium replacement flow path and a medium discharge cross flow path in operative heat exchanger relationship relative to each other and in such position that a fractional portion of treatment medium to be replaced and a substantially corresponding portion of replacing treatment medium pass continuously simultaneously through said same heat exchange means; each of said medium discharge paths being constructed and arranged for diverting said fractional portion of the treatment medium to be replaced and discharging the fractional portion out of said housing, each medium replacement path being constructed and arranged for delivering said replacing treatment medium portion from a respective housing inlet opening toward said suction inlet of said circulating means, whereby said fractional portion of the treatment medium to be replaced is continuously eliminated through the respective medium discharge path while its heat content is substantially transferred to the replacing medium portion in the replacement path in each treatment zone inside said housing means.

2. The apparatus of claim 1, wherein each heat exchange means comprises throttle means positioned in the medium replacement path for regulating the volume of replacing medium flowing in the replacement medium path.

3. The apparatus of claim 1, wherein said outlet opening for the fractional portion of treatment medium to be replaced and the inlet opening for the replacing treatment medium portion are located in said housing means in adjacent housing walls extending relative to each other substantially at 90° so that said medium replacement flow path connected to said inlet opening and said medium discharge flow path connected to said outlet opening cross each other substantially at 90°.

4. The apparatus of claim 2, wherein said throttle means comprises flap means or slider means.

5. The apparatus of claim 1, wherein each of said treatment zone comprises filter means positioned in the medium discharge flow path upstream of said heat exchange means for filtering impurities from the fractional portion to be discharged prior to passage through the heat exchanger.

6. The apparatus of claim 1, 2, or 5, wherein said heat exchange means and said housing means are constructed and arranged to facilitate removal and replacement of said heat exchange means through said opening in the housing means.

* * * * *